United States Patent [19]

Travor et al.

[11] 3,995,558

[45] Dec. 7, 1976

[54] PROJECTILE

[75] Inventors: Bruce W. Travor, Holland, Pa.; Charles M. Johnson, Willingboro, N.J.

[73] Assignee: The United States of America as represented by the Secretary of the Army, Washington, D.C.

[22] Filed: Jan. 2, 1975

[21] Appl. No.: 538,052

[52] U.S. Cl. ..... 102/92.4; 244/3.1

[51] Int. Cl.[2] ..... F42B 13/00

[58] Field of Search ..... 102/92.1–92.6, 102/105; 244/3.1, 3.23

[56] References Cited

UNITED STATES PATENTS

| | | | |
|---|---|---|---|
| 2,941,469 | 6/1960 | Barnhart | 244/3.23 |
| 3,129,667 | 4/1964 | Wen | 102/105 |
| 3,485,460 | 12/1969 | Mertens | 102/92.4 |

FOREIGN PATENTS OR APPLICATIONS

| | | | |
|---|---|---|---|
| 2,018,881 | 4/1971 | Germany | 244/3.1 |
| 411,485 | 8/1945 | Italy | 244/3.1 |

*Primary Examiner*—Verlin R. Pendegrass
*Attorney, Agent, or Firm*—Nathan Edelberg

[57] ABSTRACT

A projectile having mainstream air flow directed to its surface region of normal air non-attachment during operational flight and in which drag frictional forces in the laminar flow boundary layer region are minimized to produce maximum range. The projectile conical nose has a forward air intake nozzle in fluid communication with a plurality of internal passageways that terminate in outlet ports circumferentially spaced along the rearmost edge of the nose member adjacent the forwardmost external or lateral surface of the projectile main body portion.

3 Claims, 1 Drawing Figure

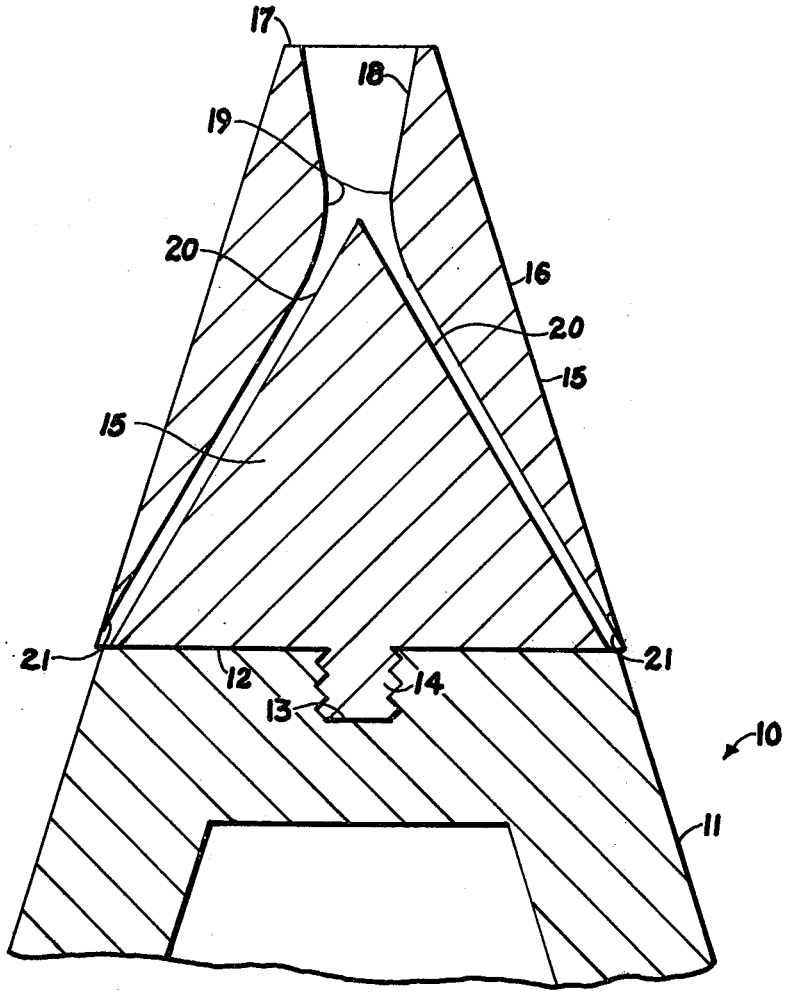
17
18
19
20
16
20
15
15
21
21
12
13
14
10
11

PROJECTILE

The invention described herein may be manufactured, used and licensed by or for the Government for governmental purposes without the payment to us of any royalty thereon.

Inherent in launched projectiles, particularly those requiring gyroscopic stability effects, the nose surface portion has a region of normal laminar boundary layer air non-attachment which prevents the projectile from obtaining a maximum performance.

It is an object of the invention to provide a projectile that utilizes an environmental supply of air to produce a laminar flow boundary layer effect on the projectile sidewall during operational flight.

Another object of the invention is to provide such a projectile in which operational drag frictional forces are minimized by the reduction of turbulent forces on the projectile surface.

A further object of the invention is to provide such a projectile which exhibits maximum stability during its entire flight trajectory due to constant reattachmental laminar boundary layer air stream flow over its surface.

These and other objects, features and advantages will become more apparent from the following description and accompanying drawing in which the sole FIGURE is a longitudinal sectional view, partially broken away, of a projectile embodying the principles of the invention.

The projectile, shown generally at 10, has a main body element comprising a forward externally tapered portion 11 and a substantially cylindrical rearward portion (not shown) that carries a conventional rotating band. The projectile forward body portion 11 has a transverse frontal surface 12 provided with a tapped opening 13 in which is secured an appropriate threaded central stub 14 on the rearward surface of nose member 15.

The nose member 15 has a conical external or lateral surface 16 the rearwardmost portion of which is in substantially mating alignment with and slightly larger than the forwardmost lateral or external surface of conically tapered body portion 11. The nose forward end surface 17 has a central forwardly opening air intake nozzle 18, the tapered surface of which constricts at a venturi throat portion 19. A plurality (preferably 12) of individual passageways 20 have forward portions that intersect each other at the throat 19 and rearward portions that terminate in a group of circumferentially equally spaced outlet ports 21, 21 at the rearmost end of the nose member conical surface 16 adjacent the forwardmost lateral surface of body portion conical surface 11.

During the flight of a launched projectile embodying the features of the invention, environmental air enters nozzle 18, is compressed through the venturi throat 19, exits into expansion chambers or passageways 20 and out of the circumferentially spaced nose member outlet ports 21 in such a manner that the exiting air re-attachment to the projectile lateral surface of normal air nonattachment will reduce the drag frictional forces by reattaching a laminar flow boundary layer of air. The air re-attachment flow onto the projectile surface is continuous during the flight trajectory and variable as the speed of the projectile varies.

Various modifications, alterations or changes may be resorted to without departing from the scope of the invention as defined in the appended claims.

We claim:

1. In a projectile having a nose tip member threadedly secured to a main body portion having a transverse annular frontal surface, said nose member and said body portion each having a conical lateral surface in substantial mating alignment with each other, said nose member having means for changing an environmental supply of air to a constant operative reattachmental laminar boundary layer air stream flow over said body portion lateral surface, said changing means including a forwardly opening air intake throat defining nozzle and a plurality of individual unobstructed straight passageways each intersecting and forwardly terminating with the others substantially at the throat of said nozzle and rearwardly terminating in a rearmost outlet port adjacent said body portion conical surface, said passageway ports including diametrically opposed pairs of outlet ports, each pair of outlet ports being diametrically spaced by a distance substantially equal to the diametrical distance across said main body frontal surface.

2. The structure in accordance with claim 1 wherein said passage outlet ports are circumferentially spaced at the rearmost end of said nose member conical surface.

3. The structure of claim 2 wherein said nozzle is defined by a central tapered opening in a forward surface of said nose member.

* * * * *